US007316090B2

(12) United States Patent
Fleischhauer et al.

(10) Patent No.: US 7,316,090 B2
(45) Date of Patent: Jan. 8, 2008

(54) DEFENSE DEVICE, PREFERABLY SELF-DEFENSE DEVICE AND STORAGE UNIT USED THEREIN

(75) Inventors: Raphael Fleischhauer, Langenthal (CH); Jürg Thomann, Strengelbach (CH)

(73) Assignee: Piexon AG, Aarwangen (CH)

( * ) Notice: Subject to any disclaimer, the term of this patent is extended or adjusted under 35 U.S.C. 154(b) by 56 days.

(21) Appl. No.: 11/208,514

(22) Filed: Aug. 23, 2005

(65) Prior Publication Data

US 2006/0010745 A1 Jan. 19, 2006

Related U.S. Application Data

(62) Division of application No. 10/296,399, filed on Nov. 26, 2002, now Pat. No. 6,951,070.

(51) Int. Cl.
*F41B 9/00* (2006.01)
*F41C 9/00* (2006.01)

(52) U.S. Cl. ..... 42/1.08

(58) Field of Classification Search ..... 42/1.08, 42/1.15; 102/462, 463; 89/1.2
See application file for complete search history.

(56) References Cited

U.S. PATENT DOCUMENTS

| | | | | |
|---|---|---|---|---|
| 1,598,784 | A | | 9/1926 | Rae et al. |
| 1,741,902 | A | | 12/1929 | Alden |
| RE17,813 | E | | 9/1930 | von Frantzius |
| 1,947,834 | A | | 2/1934 | Driggs et al. |
| 2,432,791 | A | | 12/1947 | Osses |
| 2,829,595 | A | * | 4/1958 | Hitchens ..... 102/463 |
| 3,127,836 | A | * | 4/1964 | Silva ..... 102/430 |
| 3,315,397 | A | | 4/1967 | Gilliam et al. |
| 3,335,722 | A | | 8/1967 | Lowry et al. |
| 3,431,853 | A | | 3/1969 | Warner et al. |
| 3,507,220 | A | * | 4/1970 | McClure ..... 102/463 |
| 3,706,151 | A | | 12/1972 | McNeill |
| 3,802,430 | A | | 4/1974 | Schwebel et al. |
| 4,089,334 | A | * | 5/1978 | Schwebel et al. ..... 604/69 |
| 4,124,024 | A | | 11/1978 | Schwebel et al. |
| 5,318,492 | A | | 6/1994 | Quinn |
| 5,952,601 | A | | 9/1999 | Sanford et al. |

FOREIGN PATENT DOCUMENTS

| | | |
|---|---|---|
| DE | 32 35 013 A1 | 3/1984 |
| DE | 33 10 155 | 9/1984 |
| DE | 196 24 582 A1 | 1/1998 |
| FR | 776.954 | 11/1934 |
| GB | 937023 | 4/1962 |
| WO | WO-98/38468 | 9/1998 |
| WO | WO-00/06965 | 2/2000 |

* cited by examiner

*Primary Examiner*—Stephen M. Johnson
(74) *Attorney, Agent, or Firm*—Birch, Stewart, Kolasch & Birch, LLP

(57) ABSTRACT

A storage unit includes a nozzle unit, a storage space holding an active substance, an openable closure element sealing the storage space, a store output that includes the nozzle unit and a nozzle entry space having a circumferential inner wall arranged between a nozzle inlet and the closure element and a propellant charge and a firing charge for firing the propellant charge in order to force the active substance out of the storage space through the store output into a free environment, where the closure element is configured to remain attached to the storage unit and not interfere with the discharge of the active substance.

12 Claims, 7 Drawing Sheets

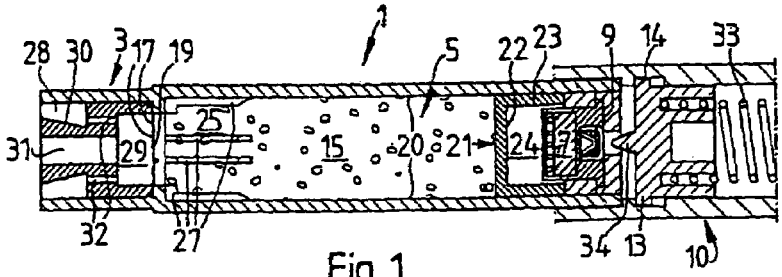
Fig. 1
Fig. 3
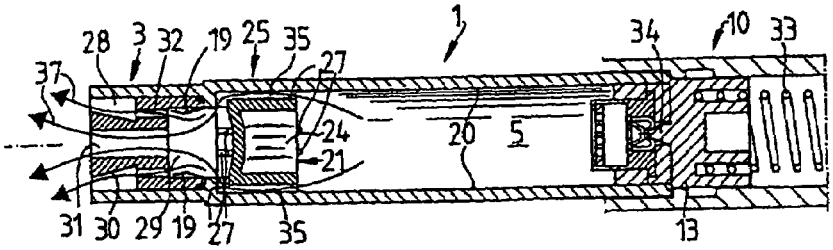
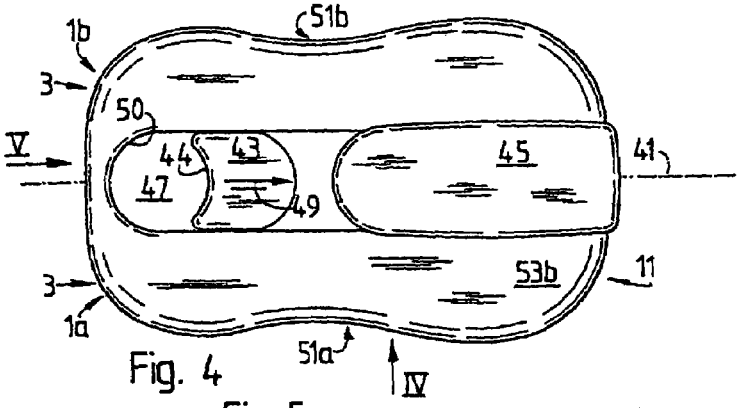
Fig. 4
Fig. 5
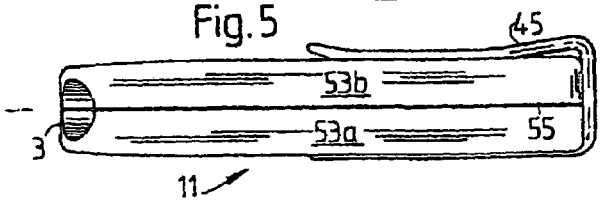
Fig. 6
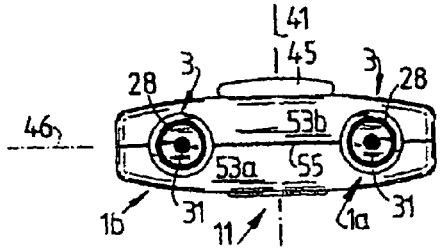

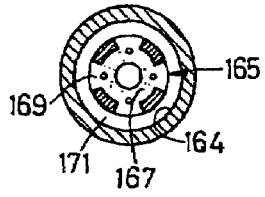
Fig. 22
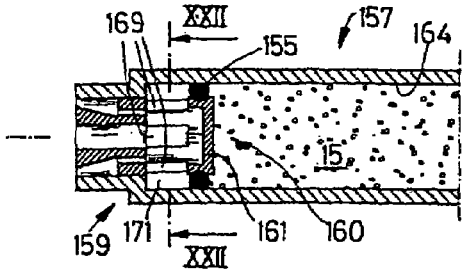
Fig. 20
Fig. 21
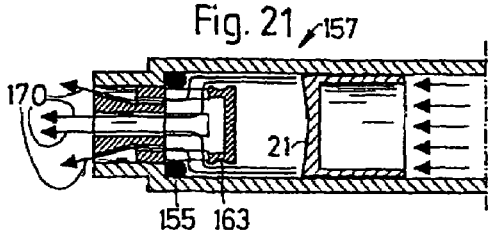
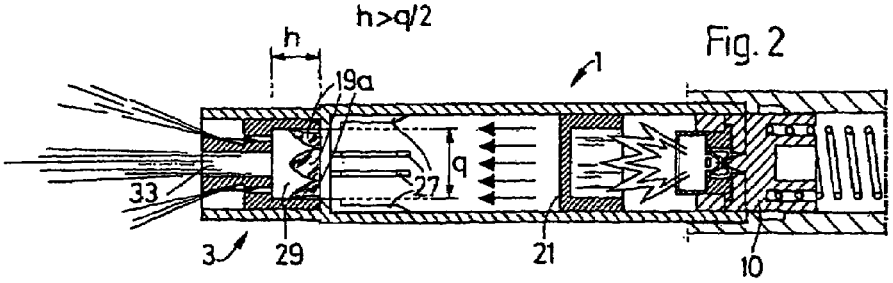
Fig. 2
Fig. 25
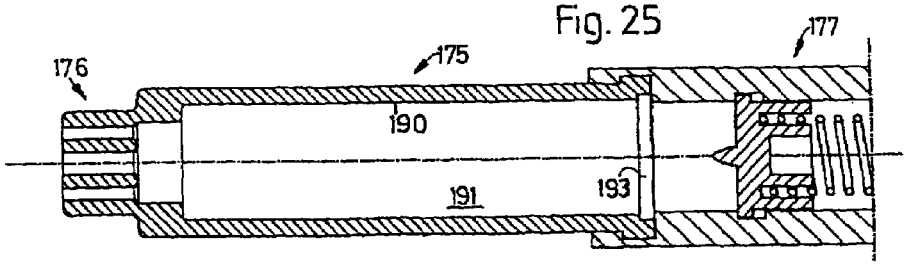
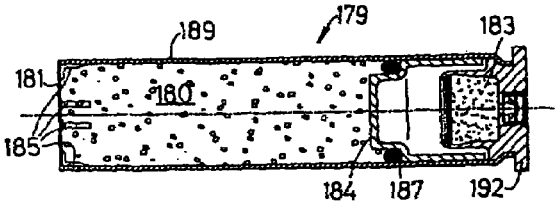
Fig. 26

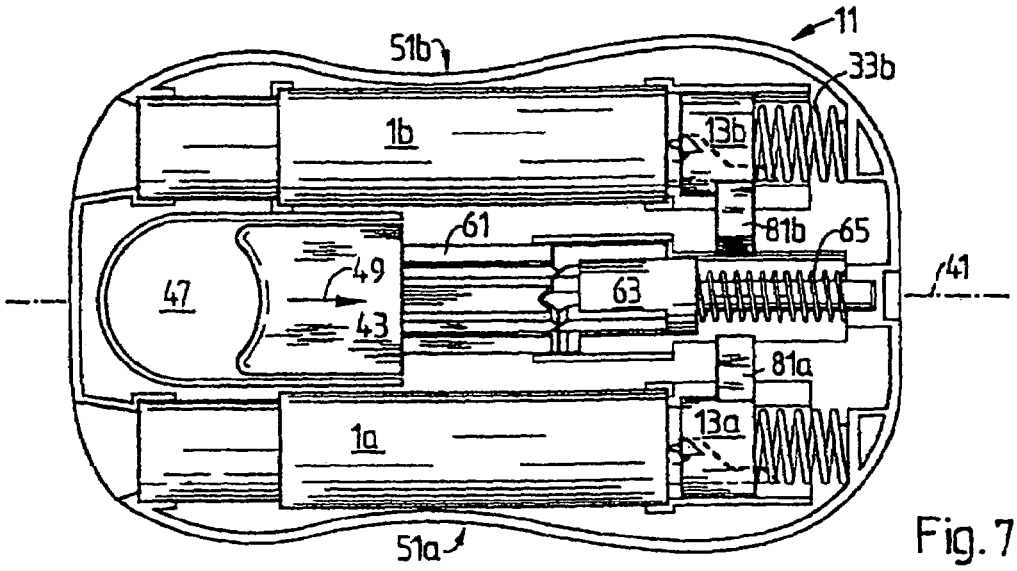
Fig. 7
Fig. 8
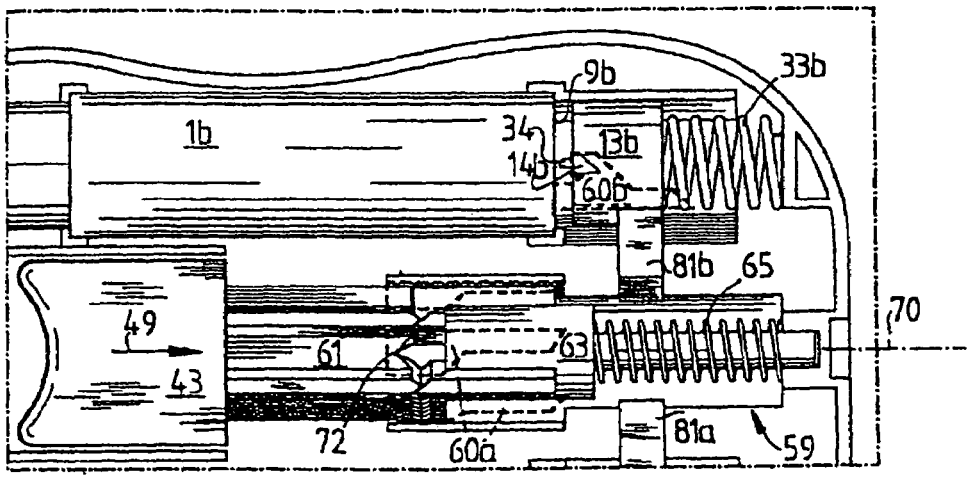
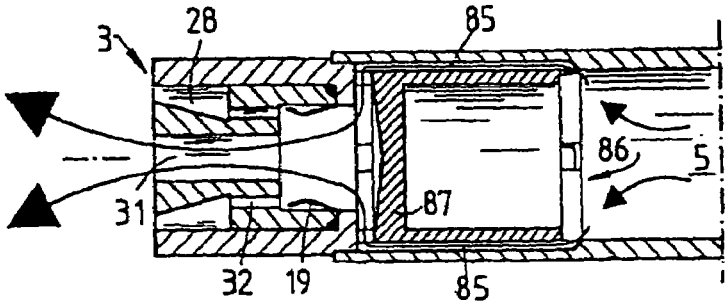
Fig. 15

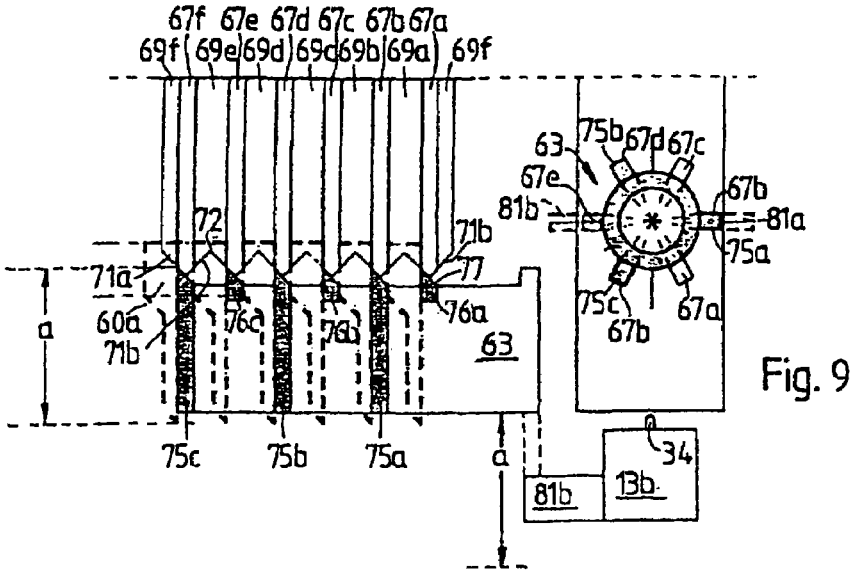
Fig. 9
Fig. 10
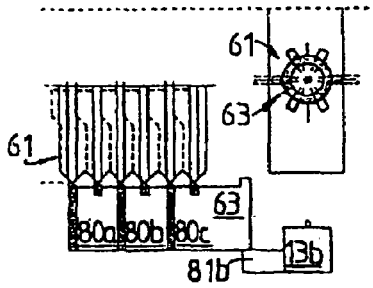
Fig. 11
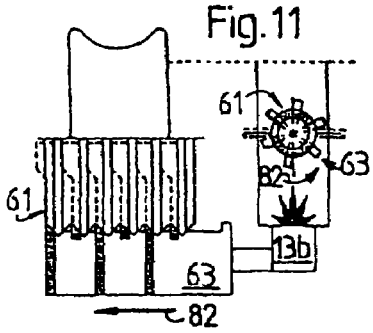
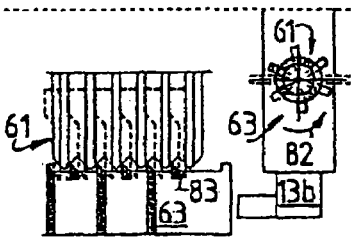
Fig. 12
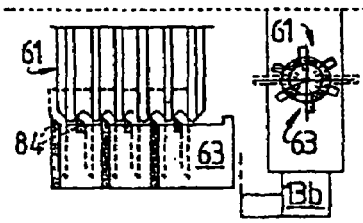
Fig. 13
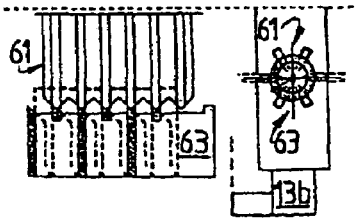
Fig. 14

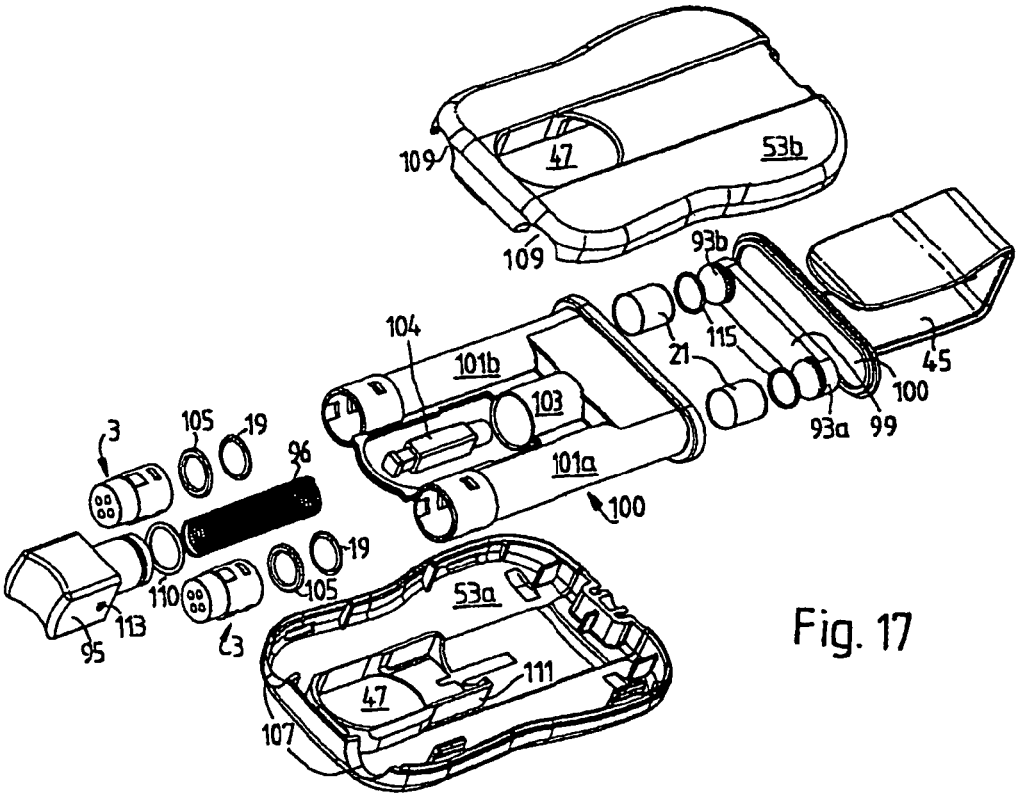
Fig. 17
Fig. 16
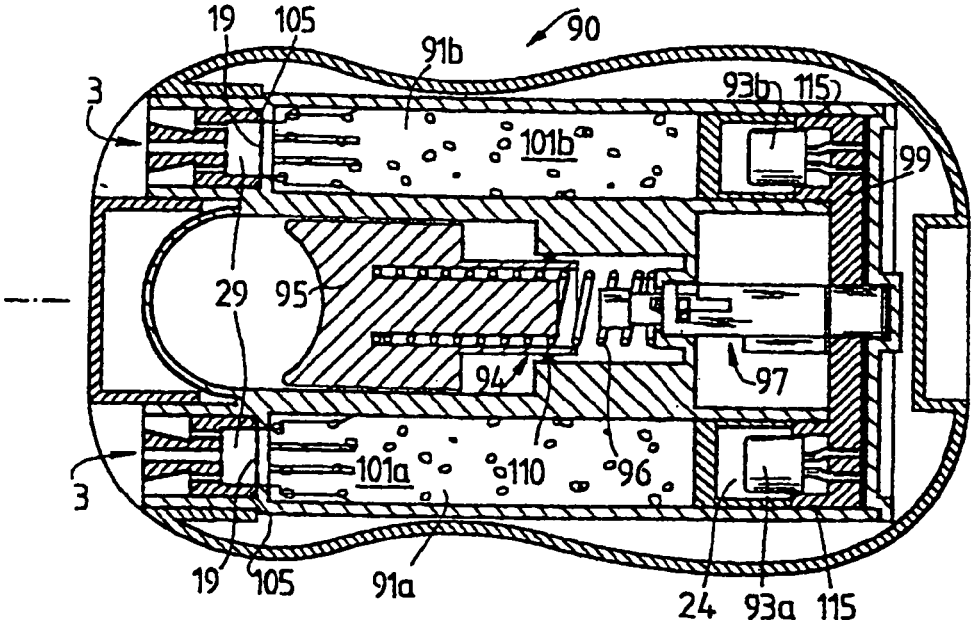

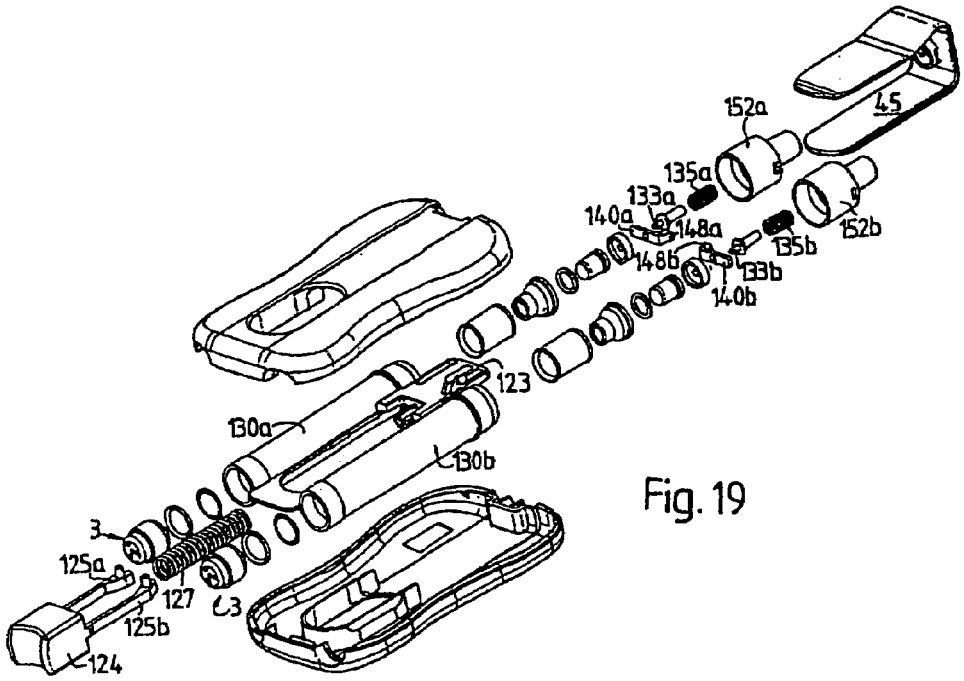
Fig. 19
Fig. 18
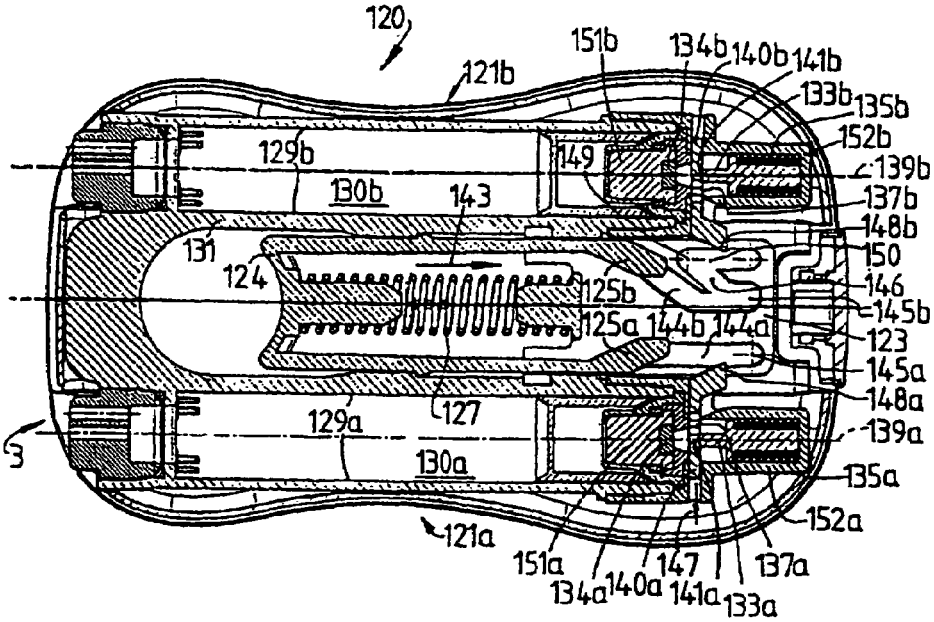

DEFENSE DEVICE, PREFERABLY SELF-DEFENSE DEVICE AND STORAGE UNIT USED THEREIN

This application is a Divisional of application Ser. No. 10/296,399, filed on Nov. 26, 2002, now U.S. Pat. No. 6,951,070 the entire contents of which are hereby incorporated by reference and for which priority is claimed under 35 U.S.C. § 120.

Thus, U.S. Pat. No. 4,089,334 describes a disposal spray in which an immunization substance is "fired" without any needle directly through the skin. The immunization substance was located in a cylinder which was closed by a piston. The cylinder face opposite the piston had at least one opening through which the immunization substance could emerge after the propellant charge had been fired. It was fired by means of a firing cap.

A disposal spray without an injection needle is known from U.S. Pat. No. 4,124,024, in which the active substance could be injected through the skin into the human tissue. The disposal spray had an outlet channel which was provided with a protective capsule and tapered conically in the outward direction. The output channel was closed at its base by a bursting disk. The storage space for the active substance merged from a part with a circular-cylindrical cross section into a conically tapering part, at whose narrowest point the bursting disk was arranged. The active substance to be injected was enclosed between a piston and this bursting disk. The piston surface facing the active substance had a truncated conical space, which was matched to the storage space taper and on whose upper truncated conical surface a conical pyramid was arranged. The other piston surface was designed to be concave. A space was provided between the concave piston surface and the firing charge in order to allow the pressure of the propellant gases to build up against the piston after firing.

Once the firing charge had been fired, the piston was pressed against the outlet channel, resulting in the bursting disk breaking, but still being held against the channel wall at its edges. The active substance could now emerge through the outlet channel and through the skin. One particular feature in U.S. Pat. No. 4,124,024 was aimed at making it impossible for any explosive gases to reach the outlet channel. A number of sealing points were provided for this purpose: one seal by means of the concave piston surface, one seal approximately in the center of the side piston wall, a further seal in the area of the burst bursting disk, which was pressed against the conical piston surface.

WO 00/06965 describes a self-defense apparatus. The self-defense apparatus had at least two barrels each having an initial firing charge which could be ignited electrically as well as a shooting charge which had a propellant filling and an active filling, and the self-defense apparatus also had an initiating unit, with a piezoelectric high-voltage pulse source, and a switching unit. One of the initial firing charges could in each case be electrically connected via the switching unit to the high-voltage pulse source for firing. The initiating device had a trigger element, whose manual operation acted on the high-voltage pulse source in order to produce a high-voltage pulse. The switching unit was designed to automatically produce an electrical connection to in each case one initial firing charge which had not yet been fired, without any influence of the propellant filling which had been fired or a battery element. The two shooting fillings were installed in a barrel unit; the barrel unit could be replaced only as an entity. Each shooting filling had a nozzle unit immediately in front of a storage space for the propellant and active filling as well as a propellant charge in order to force the active filling out into free space once the propellant charge had been fired. Each nozzle unit was sealed by a closure element. The closure element was likewise shot out into free space on firing.

DESCRIPTION OF THE INVENTION

Object of the Invention

The object of the invention is to provide a defensive apparatus, preferably a self-defense apparatus, which unit which can preferably be used in this defensive apparatus or self-defense apparatus and ensures safe, simple use, since its storage contents (filling) are reliably sealed and, once the storage contents have been "fired", they are distributed in a predetermined distribution configuration in free space, and in which case only the store contents can emerge, but no other parts, on firing. This storage unit can be integrated in a manner which is not obvious in a self-defense apparatus according to the invention.

Achievement of the Object

A defensive apparatus which is easy to use and has at least one storage unit pair, preferably a self-defense apparatus, which can be operated without any problems even by an untrained user and, furthermore, which cannot be recognized as a "handgun" by a potential opponent is achieved by designing the apparatus to be symmetrical. This means that it has a plane of symmetry with respect to which in each case one storage unit of each pair is located symmetrically. Furthermore, a single initiating device is provided, which has a single control slide, a so-called trigger, by means of which the filling of in each case only one storage unit can be released into free space with a predetermined distribution configuration. The control slide is located centrally between storage units of the pair or of the pairs in the plane of symmetry, in order that the self-defense apparatus can be operated by both left-handed and right-handed people.

Each storage unit of the storage unit pair has a solid (for example capable of being pulverized), gaseous and/or liquid filling which is stored in a storage space, as well as a pyrotechnically operating propellant charge, in order to force the filling out of the storage space into free space by means of a propellant gas which is produced when the propellant charge is fired, and by whose effect an attacker can be rendered harmless.

The defensive apparatus, preferably the self-defense apparatus, will preferably be designed to fit the palm of the hand, in order that it can be held in the hand well and, furthermore, can also be concealed well in the hand. One preferred embodiment of the self-defense apparatus has an aperture centrally in the front area, adjacent to the nozzle units, into which the operating slide projects, having an initiation movement which enlarges the aperture cross section. The aperture is designed to be sufficiently large that a free space for a finger is provided between the free edge of the control slide, before it has been pushed in, and the aperture edge. This allows correct operation.

Each storage unit of the defensive apparatus has a store output, in particular a nozzle unit. The housing contour configuration in the defensive apparatus is preferably chosen such that it does not have any similarity in appearance to a handgun. [lacuna] integrated outlet opening or openings of each nozzle unit will therefore be incorporated in the housing contour, and a flat housing external contour configuration, which fits the palm of the hand well, will preferably be chosen, preferably with a waist in order to improve the position in the hand. In addition to the first plane of symmetry, which has already been mentioned above, one particular embodiment of the housing has a further plane of symmetry which runs at right angles to the first plane of symmetry and, in particular, forms a half-and-half housing subdivision, with a groove, which runs along this housing subdivision, preferably an assembly groove, running centrally to the output of each storage unit, so that the groove can be used as an aiming aid.

The initiating device has a switching unit which, after ignition of the firing filling and release of the control slide switches the latter such that it interacts with a storage unit which can still be fired, provided such a storage unit is still present. Furthermore, a holding unit can be provided, by means of which it can be attached to the clothing of the person carrying it.

Safe use of the storage unit according to the invention on its own or installed in a defensive apparatus is achieved by making it impossible for any fragments of a closure element, which closes the storage space and bursts after firing of the propellant charge, to reach the exterior.

If the storage unit is used, for example, in a self-defense apparatus, the aim is to provide for the active substance to be forced out as uniformly as possible over a predetermined time period, in order to achieve a uniform jet pattern formed by the emerging storage contents (filling), thus increasing the accuracy of aiming at an attacker. Forcing it out in a uniform manner in this way firstly means that a nozzle entry space is provided between the closure element and the nozzle inlets, and acts, inter alia, as a stabilizing space. This nozzle entry space is also required for correct opening of the closure element and to provide the necessary space for its parts that are torn open. The presence of this nozzle entry space thus prevents nozzle channels from being blocked or their cross-sections from being reduced by parts torn open from the closure element. Once the filling has been released by the closure element, it flows first of all into the nozzle entry space, by which means it is very largely possible to dissipate peak pressures of the filling being fired into it, and vortices. Only then do the "stabilized" storage contents enter the nozzle channels, and can then leave these channels with the desired configuration and effect on the target.

If the storage unit is integrated in a defensive apparatus, then the configuration of the emerging filling, mainly the jet directed at the attacker, should have as constant a pressure as possible. The propellant filling is over designed in order furthermore to ensure that it is forced out in a uniform manner. In addition, an expansion space is provided between the piston surface which forces out the filling and the propellant filling. This results in the first pressure peak after firing being absorbed, thus assisting the process of forcing out with an approximately constant force, and hence with a filling configuration which is constant over the forcing-out period, into free space.

On the other hand, furthermore, a pressure relief means is provided which, in contrast to the storage unit which is described for example in U.S. Pat. No. 4,124,024 but is not of this generic type, ensures that the propellant gas escapes completely. When firing the filling which is stored in the storage unit, no solid parts reach the exterior. In addition, the fired storage unit has no internal space subjected to the pressure of the propellant gas; it thus no longer involves any dangers.

In order to achieve a predetermined filling distribution in free space, the propellant filling must be overdesigned. This means that the propellant filling cannot be chosen such that it would just be sufficient to drive the piston forward. A certain residue pressure must therefore also still be present when the piston is in the final position. This residue pressure is then dissipated by means of a special configuration, described below, of the piston, which forces out the filling, and of the store wall, so that this residue pressure can be discharged through the nozzle channels.

In order to achieve a predetermined filling distribution (active substance distribution) in free space, a number of nozzle channels will furthermore preferably be used: at least one nozzle main channel for the long-range effect (concentrated jet) and at least one secondary channel, and preferably a number of secondary channels, arranged around it for the short-range effect (jet with a wide opening angle). The closure element, which has already been mentioned above, closes all the nozzle channels via the nozzle entry space. When the propellant charge is fired, the closure element, which is preferably in the form of a bursting disk, is then torn open in such a way that the segments remain held such that they are secured well at their edges. The tearing-open process also takes place in such a way that the fragments do not impede the filling flow to the nozzles. The bursting disk can also have points with notches incorporated in them in advance, or points where the material is thinned, in order to tear open in a predetermined manner.

When the storage unit is used in a defensive apparatus, one nozzle unit will be designed with at least one main nozzle channel and at least one secondary nozzle channel, but generally with a number of secondary nozzle channels, arranged around it. If the filling is a liquid, the main nozzle channel should produce a straight jet up to a range of four meters, and the secondary nozzle channels should produce a large filling cloud up to two meters.

In order to allow the storage unit to be handled safely, care should be taken to ensure that the pressure does not remain raised after "firing" even with an overdesigned propellant filling. As described below, this raised pressure is produced by a special configuration of the piston, which forces out the filling, and/or of the end area of the storage space. When the piston reaches this end area, then the raised pressure can be dissipated past the piston sidewall, through the nozzles.

The complete dissipation of the residue gases through the nozzle unit also has another advantage: specifically, if the piston is located in the storage space in its limit position, then all the filling which is still located in the storage space, in the nozzle unit and in the nozzle entry space will be blown out here. The amount of filling can thus be predetermined in an optimum manner. No more filling can thus emerge from a defensive apparatus which has been disposed of or from a fired defensive apparatus to be disposed of, this precludes any danger retrospectively to those not involved with the apparatus.

If the storage unit is used in a self-defense apparatus, then an irritant liquid or an irritant gas is used as the filling (active substance), although powdery substances can also be used.

The substances listed below may be used, by way of example, as liquid active substances:

A Capsaicin solution is already used at the moment in known "pepper sprays". Capsaicin is an extract from the chilly pepper plant which is generally dissolved in a concentration of between 1% and 4% in alcohol. Capsaicin leads to sudden, temporary inflammation of all the mucus membranes with which it comes into contact (for example eyes, breathing passages). Capsaicin is thus effective both against people and animals. In contrast to Lacrimonium, which is mentioned in the following text, it leads to involuntary closure of the eyes.

A CS solution can be used as a further liquid filling (active substance). CS is a Lacrimonium which produces tears. As an additional effect, it produces severe nettle rash on the skin. CS is effective only against people.

CN solutions may also be used. CN leads to nausea. However, it acts more slowly than the CS or Capsaicin solution.

Foul-smelling secretions can also be used as liquid fillings. Most foul-smelling secretions also lead to nausea.

CS and CN may also be used in gaseous form, instead of a liquid filling.

Capsaicin, for example, may also be used as a solid filling (active substance) for self-defense, and is crystalline in its pure form at room temperature. However, solutions act more quickly than fillings which are emitted in solid form and are then pulverized. Nonetheless, pulverizing fillings have the advantage that they remain as a cloud in space for a certain period of time.

Mixtures of liquid and gaseous substances may also be used as fillings. These are then often foams which adhere to the attacker being defended against. Once again, Capsaicin may be used here.

Mixtures of solid and liquid active substances likewise often contain Capsaicin. These are, for example, gels. Dies may also be used for subsequent identification and marking of a criminal.

Further advantages of the invention and its embodiment variants will become evident from the following statements.

BRIEF DESCRIPTION OF THE DRAWINGS

Examples of the storage unit according to the invention and of its preferred integration in a defensive apparatus according to the invention will be explained in more detail in the following text with reference to the following drawings, in which:

FIG. 1 shows a cross section through a storage unit according to the invention whose propellant charge has not yet been fired;

FIG. 2 shows a cross section through the storage unit illustrated in FIG. 1, shortly after firing of the propellant charge;

FIG. 3 shows a cross section through the storage unit illustrated in FIG. 1, after firing of the propellant charge and with the filling (active substance) having been forced out completely;

FIG. 4 shows a view of the rear face of the defensive apparatus according to the invention;

FIG. 5 shows a side view of the defensive apparatus illustrated in FIG. 4, viewed in the direction IV in FIG. 4;

FIG. 6 shows a plan view of the end face, facing a potential attacker, of the defensive apparatus illustrated in FIG. 4, looking in the direction V in FIG. 4;

FIG. 7 shows a plan view of the "interior" of the defensive apparatus illustrated in FIG. 4, with one half of the housing removed;

FIG. 8 shows an enlarged illustration of only the upper symmetrical part of the "interior" illustrated in FIG. 7;

FIG. 9 shows a schematic illustration of the movement sequence on operation of the control slide of the initiating device of the defensive apparatus in the direction of the arrow as shown in FIG. 4, with this figure still showing the rest position; the left half of the figure shows the rotor and the extension bolt in a "developed" illustration, and the right half of the figure shows a plan view of the extension bolt with the rotor lying on it (shown dotted and filled); the dashed lines show the guide curves 60*a*, which are likewise shown by dashed lines in FIG. 8; in order to allow details to be identified well by their reference symbols, the illustration in this figure has been chosen to be larger than an analogous illustrations in the subsequent FIGS. 10 to 14;

FIG. 10 shows an illustration analogous to FIG. 9, with the control slide having been pushed in through the distance a shown in FIG. 9;

FIG. 11 shows an illustration analogous to FIG. 9, with the control slide having been pushed in completely, and the firing filling having just been fired;

FIG. 12 shows an illustration analogous to FIG. 9, with the control slide having just been released, and the rotor starting to rotate in the rotation direction;

FIG. 13 shows an illustration analogous to FIG. 12 with a rotor shortly before reaching its limit position;

FIG. 14 shows an illustration analogous to FIG. 9, with the rotor and the extension bolt being located in their new rest position, in which the rotor is ready to be pushed in once again in order to engage with another storage unit;

FIG. 15 shows a variant of the embodiment of a storage space end area of the storage unit illustrated in FIGS. 1 and 3;

FIG. 16 shows a variant of a defensive apparatus with piezoelectric firing;

FIG. 17 shows an "exploded illustration" of the defensive apparatus shown in FIG. 16, as a variant;

FIG. 18 shows a cross section through a variant of the defensive apparatus illustrated in FIGS. 4 to 8 as well as 16 and 17;

FIG. 19 shows an "exploded illustration" of the defensive apparatus illustrated in FIG. 18;

FIG. 20 shows a cross section through the front part of a storage unit which is illustrated in an analogous manner to the storage unit illustrated in FIGS. 1 and 3, but with the closure element being in the form of a moving "sealing ring";

FIG. 21 shows a cross section analogous to FIG. 20, but with the closure element in this case releasing the filling to be forced out, however, FIG. 22 shows a section along the line XXII-XXII in FIG. 20, FIG. 25 shows a longitudinal section through the storage unit illustrated in FIGS. 23 and 24 with the filling tank removed, and FIG. 26 shows a longitudinal section through the filling tank removed in FIG. 25, which is provided as a spare part.

APPROACHES TO IMPLEMENTATION OF THE INVENTION

Figure 23:
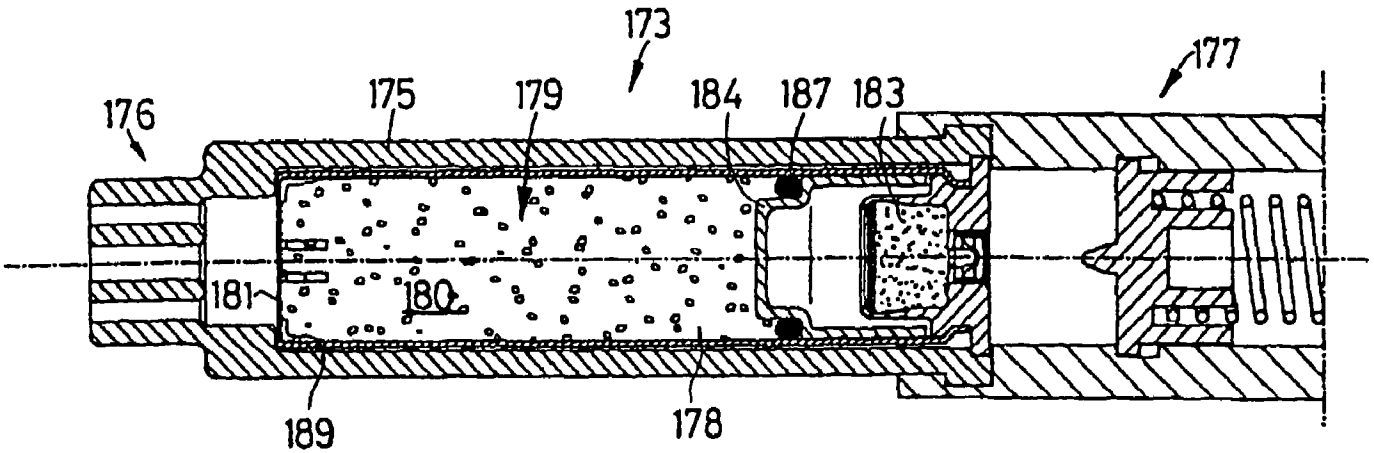
FIG. 23 shows a longitudinal section through a variant of the storage units illustrated in FIGS. 1 to 3, before it has been fired.

The storage unit 1 illustrated in the form of a cross section in FIGS. 1 to 3 is designed as a so-called cartridge and is preferably used in a defensive apparatus, preferably a self-defense apparatus. On the left in FIGS. 1 to 3, the cartridge 1 has a nozzle unit 3. Furthermore, the cartridge 1 has a storage space 5, a pyrotechnic propellant charge 7 and a pyrotechnic firing charge 9 for firing the propellant charge 7. FIGS. 1 to 3 furthermore show a mechanical firing cap unit 10 which, however, is part of the self-defense apparatus 11 described in the following text. The striking unit 13 of the firing cap unit 10 is held in a catch 14 in its rest state as illustrated in FIG. 1. The striking unit 13 can be rotated by means of a mechanism, which is described in the following text, out of the catch 14 in order to release a free striking path.

Depending on the purpose, solid (which can also be pulverized), gaseous and/or liquid fillings (active substances) 15 can be stored in the storage space. Mixtures between powdery, gaseous and/or liquid different active substance components can also be stored. A liquid filling 15 is stored in the exemplary embodiment illustrated here. Since, in accordance with the description in the following text, the storage unit 1 is intended to be integrated in a self-defense apparatus 11, the filling 15 is intended to achieve an immediate effect on the mucus membranes (eyes, breathing passages) of a potential attacker. The storage space 5, which is filled with the filling 15, is sealed toward the nozzle unit 3 by a closure element 19 which has material thinning lines 17 arranged in a star shape. The closure element 19 prevents the filling 15 from escaping from the storage space 5 through the nozzle unit 3 when it is not being fired.

The storage space 5 is closed in a sealed manner toward the propellant charge 7 by a piston 21 which is fixed in a clamped seat in the cylindrical wall 20 of the storage space 5. The piston 21 is designed like a pan with a pan base 22 and a pan casing 23. The piston 21 is also referred to as a propellant disk. The pan interior 24, as a free space between the propellant charge 7 and the pan base 22 which is connected to the filling 15, is used as an expansion space 24 in order to move the piston 21 forward as uniformly as possible, eliminating any pressure peaks, once the propellant gases have been produced from the ignited propellant charge 7. The expansion space 24 has a volume which is approximately equivalent to one eighth of the liquid volume of the filling 15. The seal can also be provided by an additional sealing element (O ring, lipseal, . . . ).

Pressure relief means 27 are arranged in the storage space end area 25 adjacent to the nozzle unit 3. In this case, the pressure relief means 27 are designed, by way of example, as webs which project into the storage space end area 25. As the name itself suggests, the pressure relief means 27 are used to reduce the pressure of the propellant gas in the storage area 5 once the filling has been forced out completely. The method of operation is explained in the following text. With the complete dissipation of the residue gases, the remaining residue of the filling is also blown out of the storage space 5, out of the nozzle unit 3 and out of the nozzle entry area 29. The amount of filling can thus be predetermined in an optimum manner.

A nozzle entry space 29 which, inter alia, can act as a stabilization space, is provided between the closure element 19 and the start of the nozzle channels in the nozzle unit 3. The nozzle entry space 29 is in this case designed with a circular-cylindrical diameter; other cross sections are, of course, possible. The nozzle entry space 29 is used, as can be seen in particular in FIG. 2, to provide space for those parts 19*a* of the bursting disk 19 which are torn open by the build up in pressure on firing, without blocking the nozzle main and secondary channels 31 and 32, and on the other hand to stabilize the accelerated filling 15 and to minimize the vortices in the liquid in the nozzle channels. The depth h of the nozzle space 29 is preferably greater than its internal radius q/2. The bursting disk 19 is thus stretched freely in front of the nozzle entry space 29 while, in contrast, its edges are firmly clamped. Thus, once the burning propellant charge reaches a predetermined gas pressure, the bursting disk 19 tears in a star shape, that is to say starting from the center. This radial tearing in the form of segments ensures that no fragments of the bursting disk 19 are shot as solid bodies out of the nozzle unit 3, since the edges of the bursting disk 19 are still held firmly. The torn open bursting disk segments then rest against the wall of the nozzle entry space at the side, without blocking the nozzle channels, since this is deeper than the length of the torn-open segments of the bursting disk 19. The nozzle entry space 29 thus carries out two functions: it allows the closure element to open without parts of it being torn off or blocking the nozzle channels or in any way impeding the flow, and it reduces the pressure peaks and vortices of the filling which is fired into it. It thus assists the filling being passed without vortices through the nozzle channels in a predetermined configuration. The nozzle entry space and the closure element (when in the open state) are matched to one another in order to carry out this function.

The nozzle unit 3 has a centrally arranged main nozzle channel 31 and a number of coaxially arranged secondary nozzle channels 32, in this case four. A number of main nozzle channels and only one secondary nozzle channel or a number of main channels and a number of secondary channels may, of course, also be provided. The number and arrangement of the nozzle channels are governed by the application and the desired spatial distribution of the filling. The four secondary nozzle channels 32 open, for example, into an annular space 28 which surrounds the main nozzle channel 31 which, in order to "atomize" the liquid emerging from the secondary nozzle channels 32, has a circumferential incline 30 on which the secondary jets are broken and atomized. The main nozzle channel 31 is designed such that an approximately straight liquid jet emerges from the filling 15, which is forced out by the propellant gas, up to a distance of four meters, having large droplets after the droplet formation process. The secondary nozzle channels 32 are intended to produce a large scatter circle with finely distributed small droplets of filling as an active substance cloud.

In order to force out the filling 15 in the case of a storage unit 1 which is integrated in a self-defense apparatus 11, the striking unit 13 is unlocked in a first step. The unlocking process takes place by rotating the catch 14 out of its holding position. The striking unit is then pushed to the right in FIG. 1, loading a spring 33, and is then released. The force of the loaded spring 33 shoots the striking bolt 34 of the striking unit 13 against the firing charge 9, which ignites and acts as an initial igniter for the propellant charge 7. The propellant charge 7 starts to burn, with the propellant gases which are produced entering the expansion space 24 and, after a short time interval, the propellant gas expansion force exceeding the clamping force of the piston 21 with the storage space wall 20, so that the piston 21 is driven in the direction of the nozzle unit 3. The pressure in the filling 15 arises suddenly. This pressure rise acts on the bursting disk 19, which tears open along its thinned material lines 17, which are arranged in the form of a star. The bursting disk 19 is held well at its outer edges in front of the nozzle entry space 29. Although it tears open, no fragments moving away from it are formed, however, since the bursting disk edge is held firmly even after the bursting disk has torn open. The bursting disk segments rest against the wall of the nozzle entry space 29, as indicated in FIG. 2. They do not impede the liquid emerging through the nozzle unit 3, since the depth h of the nozzle entry space 29 is deeper than the length of the torn-open bursting disk segments 19*a*. The nozzle entry space 29 thus allows the bursting disk 19 to tear open in the form of a star into segments as desired, and on the other hand, also serves to prevent vortices in the active liquid (filling which is forced out) in the nozzle channels themselves. These vortices resulting from partially concealed and a blocked nozzle channel inlets would have a negative influence in particular on the range of the liquid jet emerging through the main nozzle channel 31.

When the piston 21 enters the storage space end area 25, its slides over the pressure relief means 27, which are in the form of webs. This sliding-in process results firstly in deformation of the piston 21 and secondly in a braking effect, thus preventing it from striking the nozzle unit 3. This prevents parts of the nozzle unit 3 or of the storage unit 1*a* or 1*b* from being torn off when the piston (propellant disk) 21 strikes in the storage unit end area, and flying away with high inertia. The transition between the nozzle unit 3 and the wall 20 need in consequence not be designed to be as robust, which allows a simpler structure. The deformation of the piston 21 results in side channels 35 between the wall 20 and the pan casing 23. The remaining propellant gas can then escape through these channels 35, as indicated by the arrows 37 in FIG. 3. The remaining gases are in this case blown out through the nozzle unit 3. This also results in the nozzle channels being blown out completely so that no residue amount of filling remains in them. The self-defense apparatus can be placed down at any desired location after being fired without any possibility of the filling residue causing any effect whatsoever. After being fired, the remaining storage unit 1 can be handled and stored without any pressure, and thus without any problems.

The described configuration of the closure element, in this case the bursting disk 19, of the nozzle entry space 29 which is matched to it, as well as the pressure relief means 27 ensures that no solid parts, such as parts of the nozzle unit 3, of the piston 21 or of the closure element (bursting disk 19) can be shot out on firing. A self-defense apparatus 11 fitted with this storage unit 1 may thus be sold without any restrictions in most countries, since there is no risk of injury to an attacker being fired at by particles (fragments, bursting disk parts).

This storage unit may, but need not, be integrated in the self-defense apparatus according to the invention as described in the following text. The self-defense apparatus described in the following text may itself also understandably be fitted with other storage units, carrying a filling, for defense against attacks. Such integration achieves the object of providing a self-defense apparatus which on the one hand can be used without any problems by people without any training, and does not represent a residual risk after being "fired". The self-defense apparatus can also be designed such that it has no similarity whatsoever to a handgun, and nevertheless allows good aiming.

Self-defense apparatuses which cannot be recognized as handguns are known. By way of example WO 98/38468 describes a self-defense appliance which cannot be recognized as a pistol. The appliance has the appearance of a key tag. It has two barrels, whose fillings can be initiated by means of in each case one initiating button per barrel. Firing bolts which can be prestressed are provided for igniting the firing filling. A solid body is fired as the projectile.

Self-defense appliances designed in an analogous manner to this are known from U.S. Pat. No. 1,741,902, DE 3 310 155 and FR 776 954. FR 776 954 allows the use of a large number of cartridges; among other cartridges, these also include teargas cartridges.

DE-A 196 24 582 describes a storage unit which can be used as a defensive apparatus for liquid fillings, which vaporize on use. A blocking sheet was arranged immediately in front of the nozzle inlets, sealing them. The blocking sheet was used to prevent the filling from emerging inadvertently through the nozzle passages. A firing charge was ignited in order to force out the filling, and its propellant gases acted on a piston which in turn built up a pressure in the filling until it burst the blocking sheet in front of the nozzle inlets. When the blocking sheet burst, its fragments were forced into the nozzle passages, following the filling either as parts through the nozzle channels to the exterior, or remaining stuck in these nozzle channels, thus impeding the process of forcing out the filling.

Instead of a blocking sheet, U.S. Pat. No. 2,432,791 used a wax plug in front of the nozzle inlet. When it is shot out, this wax plug also acts as a projectile and can cause injuries. If it is not shot out, it can also lead to blocking of the nozzle channel or to an adverse effect on the flow of the filling in the nozzle channel.

All these appliances lack safety in use and/or in final storage, however.

The object of providing a self-defense apparatus which can be used without any problems is achieved in that this apparatus has two storage units, which are arranged symmetrically with respect to a plane of symmetry, as well as only a single trigger for the storage units which can be "fired" successively, with automatic switching to a storage unit which can then still be fired. The self-defense apparatus is designed such that it can be operated by both left-handed and right-handed people. Further advantages of the self-defense apparatus are described in the following text.

The self-defense apparatus 11 as illustrated in FIG. 4 has a first plane of symmetry 41, symmetrically with respect to which in each case one storage unit 1*a* or 1*b*, which cannot be seen directly, is integrated as a pair. Of the two storage units 1*a* and 1*b* only the nozzle outlets of the respective nozzle unit 3 of the main nozzle channel 31 and of the secondary nozzle channels 32 can be seen when a front view (FIG. 6) is viewed in detail. A single control slide 43 for initiating in each case one storage unit 1*a* or 1*b* and for operating a switching arrangement 97 is arranged in the plane of symmetry 41. Ignoring a clip (holding unit) 45 for attaching the self-defense apparatus 11 to the clothing of a user, this self-defense device 11 is also designed to be symmetrical with respect to a further plane of symmetry 46, which is illustrated in FIG. 5 and runs at right angles to the first plane of symmetry 41 through the center axes of the two storage units 1*a* and 1*b* and of the control slide (trigger) 43. The two planes of symmetry 41 and 46 apply mainly to the housing and to the arrangement of the storage unit with the control slide 43. The functional elements relating to the initiating unit 59 and to the switching arrangement 97 are not symmetrical together with these planes of symmetry 41 and 46.

The self-defense apparatus 11 is designed to fit the palm of the hand. It has an aperture 47 centrally in the front area, through which the trigger finger can be passed. The control slide 43 projects into this aperture 47. When the control slide 43 is operated in the direction of the arrow 49, the free cross section of the aperture 47 is enlarged as a result of the initiation movement. The aperture cross section 47 between the free edge 44 of the control slide 43 and the aperture edge 50 is sufficiently large to provide space for a finger to be passed through. The outlet openings of each nozzle unit 3 are integrated in the housing contour (however, they could also project beyond it). The housing of the self-defense apparatus 11 is designed to be flat, in order that it fits well in the palm of the hand and can thus be carried concealed. Furthermore, a waisted indentation 51*a* and 51*b* is provided on each of the two sides, in the form of a waist in the housing, in order to allow better handling. In fact, one indentation would actually be sufficient but, since the self-defense apparatus 11 is intended to be usable by both left-handed and right-handed people, indentations 51*a* and 51*b* are required on both sides. The housing is designed in two parts. The two housing parts 53*a* and 53*b* are in this case, for example, connected to one another in a fixed manner, and cannot be opened up, in contrast to the housing which can be opened up as explained further below. The connecting point between the two housing parts 53*a* and 53*b* is a circumferential groove 55, which lies on the plane of symmetry 46. This groove 55 runs on the plane of symmetry 46. This groove 55 can thus be used not only as a visible aiming aid but also as a tactile aiming aid for aiming at the potential attacker.

As shown in FIGS. 4 to 6, the appearance of the self-defense apparatus is similar, for example, to the reel of a wind-up dog's lead unit, to a purse, to a credit card wallet, or to other objects, but not to a handgun. Since a potential attacker cannot recognize the self-defense apparatus 11 as a weapon, the attacker's aggressiveness is not increased by it either. On the contrary, the attacker will consider himself safe and superior. He will thus be completely surprised by view, in the right-hand half of the illustration in FIGS. 9 to 14. FIGS. 9 to 14 show the relative movement sequence of the rotor 63 with respect to the extension bolt 61, and the movement of the striking unit 13*b* (FIG. 8). At their free ends, the webs 67*a* to 67*f* have two roof-like inclines 71*a* and 71*b*, which are designed to be symmetrical with respect to one another. The inclines 71*a* and 71*b* continue into the grooves 69*a* to 69*f*, to form in each case one V-shaped symmetrical incision 72.

The rotor 63 has three coaxially running webs 75*a* to 75*c*, which are at equal angularly distances from one another, as well as three truncated webs 76*a* to 76*c*, which are arranged centrally between the webs 75*a* to 75*c*. The webs 75*a* to 75*c* and the truncated webs 76*a* to 76*c* each have an incline 77, like a desktop. The inclines 77 on the rotor 63 and the inclines 71*a* and 71*b* on the extension bolt 61 engage in one another in conjunction with the guide curves 60*a* analogously to the pressing mechanism of a ballpoint pen, with a point which can be pushed down and pulled in again. The catch, which has already been mentioned above and is annotated 14*b* here, since it is part of the storage 1*b*, is guided in the guide curve 60*b*. The guide curve 60*b* is not shown in FIGS. 9 to 14.

When the control slide 43 is pushed in in the direction of the arrow 49, then the movement sequence illustrated in FIGS. 9 to 14 takes place. The rotor 63 is in this case likewise pushed in this direction, and is rotated in the process. The rotor 63 does not rotate at all until the control slide 43 (FIG. 10) has been pushed in virtually completely. During the pushing-in process, both the return spring 65 and the spring 33*b* which acts on the striking unit 13*b* are loaded. Once this position has been reached, and only then, the rotor 63 is rotated in the direction 82 such that the desktop surfaces 77 slide on the roof inclines 71*b* into the incisions 72. As a result of this rotation 82 and the rotation of the striking unit in the guide curve 60*b*, a projection 81*b* slides on the striking unit 13*b* into a groove 80 between the webs 75*a* and 75*c*. The striking unit 13*b* is now shot against the firing charge 9*b* by the force of the spring 33*b* (FIG. 11), as a result of which this charge 9*b* is ignited by the firing bolt 34. The ignited firing charge 9*b* then causes the propellant charge 7 to burn.

The propellant gases from the burning propellant charge 7 then flow into the pan interior 24, which is used as an expansion space. Once a sufficient propellant gas pressure has built up, the piston 21, which acts as a propellant disk, is driven forward. The piston 21 presses against the filling 15 which, for its part, acts on the closure element 19 which acts as a bursting disk. The closure element 19 tears open along its thinned material lines 17, which are arranged in the form of a star; however, it remains held at its edges, as shown in FIG. 2. The piston 21 is driven by the propellant gases toward the storage space end area 25, forcing out the filling 15 through the main nozzle channel 31 and through the secondary nozzle channel 32. On reaching the storage space end area 25, the entire piston 21 is deformed by the webs located on the store wall, as a pressure relief means 27, or only its sealing elements are deformed. The deformation of the piston surface 22 also results in its side walls 23 being partially pushed in, thus forming channels 35 between the piston side wall areas and the store wall in the storage space end area 25. The propellant gas can then escape through these channels 35 until the pressure is completely relieved. However, as a design variant, it is also possible to deform only one sealing element, which is fitted on the piston 21 (for example a lip seal).

When the control slide 43 is released, then the return spring 65 moves it back to its front position. In a first return step shown in FIG. 12, the webs 75*a* to 75*c* and the truncated webs 76*a* to 76*c* slide along an incline 83 on the guide curves 60*a*, causing a small amount of further rotation in the direction 82. The rotor 63 then slides back axially as far as a further incline 84 on the guide curves 60*b* (FIG. 13). The desktop inclines 77 on the webs 75*a* to 75*c* and on the truncated webs 76*a* to 76*c* then slide on the inclines 71*a* of the webs 69*a* to 69*f* of the extension bolt 61 into a new rest position (FIG. 14). In the new rest position, the projection 81*a* which is associated with the striking unit 13*a* is now ready to engage with the rotor 63 once again in order that the other storage unit 1*b* can be "fired" when the control slide 43 is pushed in again.

In contrast to the statements made above, the thinned material lines 17 in the closure element 19 can be dispensed with. This element 19 is then, for example, in the form of a thin aluminum disk.

Instead of relieving the propellant gas pressure by deformation of the piston 21 by means of the webs 27 projecting into the storage space end area 25 as described above, it is also possible, as illustrated in FIG. 15, to form grooves 85 in the store wall, in the storage space end area 86 there. The grooves 85 must then be longer than the height d of the piston 87, which is designed in an analogous manner to the piston 21, by a tolerance allowance. Once the filling has been forced out, the piston 87 strikes against a step at the end of the storage space in this embodiment variant. This means that there is a hard stop after firing, while there is only a damped stop in the embodiment variant described above with the pressure relief means 27.

A self-defense apparatus 90 which has a piezoelectric firing instead of a mechanical firing cap is illustrated in a longitudinally sectioned form in FIG. 16. The external contour of this self-defense apparatus 90 is identical to that described above. Its two storage units 91*a* and 91*b* are also constructed identically, except for the firing and propellant charge 93*a* and 93*b*. In this case as well, there is an expansion space 24 for the propellant gases in the exterior of the piston 21, which is in the form of a pan.

An initiating device 94 for the self-defense apparatus 90 in this case, analogously to the self-defense apparatus 11, has a control slide 95 as the "trigger". The control slide 95 is held in its rest position by a compression spring 96. An arrangement 97 having a piezoelectric high-voltage pulse generator and an integrated electrical switching arrangement is acted on only once a pushing-in movement has been overcome. The arrangement 97 is inserted into an electrical printed circuit board 99 with electrical connections, which are not shown, to the firing and propellant charges 93*a* and 93*b*.

Since the electrical components (high-voltage pulse generator, electrical switching, various contacts, conductors to the firing and propellant charge) of this embodiment variant are sensitive to moisture, importance is in this case placed on a water seal.

The electromechanical design of this self-defense apparatus 90 is shown schematically, in the form of an exploded drawing, in FIG. 17. The two housing parts 53*a* and 53*b* are shown at the top and bottom. The clip 45 is latched into the housing part 53*b*; although it could also be bodied or welded to it. A central injection molded part 100 has a rear cover which, after the "interior items" have been installed, is welded in a liquid-tight manner to the base housing (injection molded part) 100. The sealing rings 110 (sliding seal) and 105, which are likewise watertight, seal the base housing 100 in a liquid tight manner, as is necessary owing to the electromechanical devices contained in it. The housing parts 53*a* and 53*b* in this design variant thus have only a "bodywork function", since the base housing 100 already contains all the technical functional parts and is sealed in a liquid-tight manner. The housing parts 53*a* and 53*b* in this case thus just need to be clipped to one another.

Furthermore, the two storage spaces 101*a* and 101*b* in the storage units 91*a* and 91*b* as well as a holding sleeve 103 for the piezoelectric high-voltage generator 104 are provided. A sealing ring 105 can be placed on each bursting disk 19. The nozzle units 3 are located in recesses 109 and 107 in the respective housing parts 53*a* and 53*b* and press against in each case one of the sealing rings 105, forming a seal. The control slide 95 is likewise sealed by a sealing ring 110 from the interior of the self-defense apparatus 90. The control slide 95 is guided in a box-like sheath, although only the half box 111, which is formed in the housing part 53*a*, can be seen in the illustration in FIG. 17. The control slide 95 is protected against falling out in the direction of the aperture 47 by in each case one projection 113 at the side, which in the assembled state is formed into a corresponding groove, formed from the half boxes and the inserted injection molded part 100. The two pistons 21 are likewise each sealed by a sealing ring 115.

The storage units 1*a*, 1*b*, 91*a* and 91*b* according to the invention are used integrated in a self-defense apparatus in the exemplary embodiments described above. These storage units 1*a*, 1*b*, 91*a* and 91*b* may, however, also be used in a fixed position in the immediate vicinity of objects which are at risk. Objects such as these may be, for example, glass cabinets, shopwindows or entry doors to jewelry businesses, private villas etc. The firing charge for the storage units may, for example, be coupled to a glass-breakage sensor. As soon as someone breaking in breaks such a secured window, a storage unit installed in a fixed position is fired. The active substance (filling) which then emerges from the storage unit "forms a mist" in the room area in which the person breaking in is at that time located. The criminal is in this way kept away from his objective and, depending on the active substance that is used, is marked or is rendered incapable of movement for a predetermined time period. When the glass breakage sensor is triggered, an alarm is preferably triggered at the same time, and/or an alarm is sent to the police.

A cross section of a further variant of a self-defense apparatus 120 with respect to the variants illustrated in FIGS. 4 to 8 as well as 16 and 17 is shown in FIG. 18. The contour of the housing corresponds to that shown in FIGS. 4 to 6. In this case as well, there are two storage units 121*a* and 121*b* for an active substance. In contrast to the self-defense apparatus shown in FIGS. 7, 8, 16 and 17, the self-defense apparatus 120 has no rotating switching mechanism for firing the propellant filling, but a switching link 123. While the rotating switching process takes place in three dimensions, the switching link operates in a two-dimensional manner. A control slide (trigger) 124 produced from plastic has two sprung arms 125*a* and 125*b* and is held in its rest position by a compression spring 127. The switching link 123 and the sidewalls 129*a* and 129*b* for the storage spaces 130*a* and 130*b* form a single injection-molded part 130. The firing pins 133*a* and 133*b*, which are used to fire a respective firing unit 134*a* and 134*b*, are always subject to the pressure of a respective spring 135*a* or 135*b*. The firing pins 133*a* and 133*b* are thus already prestressed in the rest state. The two firing pins 133*a* and 133*b* are held in the cocked position in a respective trough 141*a* and 141*b* by means of a respective locking slide 140*a* or 140*b*, which is provided with a respective aperture hole 137*a* or 137*b* and can be moved at right angles to the respective axis 139*a* or 139*b* of the respective firing pins 133*a* or 133*b*. The pressure of the spring 135*a* or 135*b* provides a secure lock. The self-defense apparatus 120 is also safe in the event of being dropped. The small weight of each locking slide 140*a* and 140*b* is not sufficient to cause movement in the event of the apparatus 120 striking the ground hard.

When the operating slide 124 is now pressed in the direction of the arrow 143, then the end of the sprung arm 125*a* moves in the guide groove 144*a* of the switching link 123 as far as the point 145*a*, and the sprung arm 125*b* moves in the guide groove 144*b* as far as the point 145*b*. The end of the sprung arm 125*b* does not in this case pass through the passage 146. During this pushing-in movement, the sprung arm 125*a* passes a projection 148*a* of the locking slide 140*a*, and in consequence pushes the locking slide 140*a* in the direction of the arrow 147, as a result of which the cocked firing pin 133*a* strikes against the firing charge 134*a*, through the aperture hole 137*a*, and ignites it. The active substance is now forced out of the storage unit 121*a*.

If the control slide 124 is now released, then the end of the sprung arm 125*b* moves through the passage 146 and then remains at the point 149. In the situation shown here, the control slide 124 thus does not slide back completely to its initial position. This no longer complete backward movement indicates that one storage unit has already been fired. If the control slide 124 is now pressed for a second time, then the end of the sprung arm 125*b* slides along the groove 150, in response to which the projection 148*b* on the locking slide 140*b* is pushed in, thus releasing the firing pin 133*b* in order to ignite the firing unit 134*b*.

A pot-like housing 152*a* and 152*b* at the end of the respective storage units 121*a* and 121*b* in each case holds one of the firing springs 135*a* or 135*b*, in each case one locking slide 140*a* or 140*b*, and in each case one firing charge 134*a* or 134*b* and the associated propellant charge 151*a* or 151*b*. These housings 152*a* and 152*b* are used as wall reinforcement in the rear area of the storage units 121*a* and 121*b*, where the highest pressure peaks occur during "firing". The walls of the housings 152*a* and 152*b* are firmly connected to the ends of the storage units 121*a* and 121*b* by vibration welding.

The initiating mechanism described here is simpler than the previous initiating mechanism, which operated in a rotating manner, and can thus be produced at a lower cost.

The self-defense apparatus 120 is produced virtually completely from plastic. Only the pyrotechnic elements which hold the propellant and the firing charges 134*a*/151*a* and 134*b*/151*b* are composed of brass components. During assembly of the self-defense apparatus 120, the propellant and the firing charges 134*a*/151*a* and 134*b*/151*b* must not be heated above 100.degree. C. Encapsulation in the plastic is thus impossible, since this plastic is injection-molded at a higher temperature. The firing and the propellant charges 134*a*/151*a* and 134*b*/151*b* as well as the locking slides 140*a* and 140*b* together with the housings 152*a* and 152*b*, which hold the already cocked firing pin 133*a* or 133*b*, respectively, are thus not inserted until later. The plastic parts are then connected to one another in the "cold" state by means of vibration welding.

So far, self-defense apparatuses have been described in which a moving firing pin strikes a firing charge in order to ignite the propellant charge. However, a moving storage unit with a propellant filling and firing charge can also be shot at the stationary firing pin by means of spring force.

The storage units 1*a*, 1*b*, 91*a* and 91*b* may have considerably large mechanical dimensions. If water or some other fire extinguishing agent is then used as the active substance, storage units such as these can be used together with a smoke alarm or heat sensor for automatic firefighting. Portable firefighting appliances having a number of such storage units can also be produced.

A moveable sealing ring 155, as illustrated in FIGS. 20 to 22, can also be used as the closure element instead of the bursting disk 19 as shown in FIGS. 1, 2, 3, 15, 16, 17 and 18. In contrast to the bursting disk 19, the closure element for releasing the filling (active substance) 15 is no longer destroyed (torn open) in this case, but is moved to a different position.

FIG. 20 shows only the front part of a storage unit 157, which is analogous to the storage unit 1, surrounding the nozzle area 159. A mushroom-shaped web 160 with a cylindrical head 161 is mounted in the storage unit 157, in front of the nozzle unit 3 on the inside. A circumferential retaining groove 163 is arranged on the head face surface, in which the sealing ring 155 is seated, forming a seal to the cylinder wall 164 of the storage unit 157. The stem 165 of the web 160 has an interior 167 which is open to the nozzle unit 3. The stem wall has four longitudinally running aperture openings 169 to the interior 167. The stem length corresponds approximately to three times the diameter of the sealing ring 155.

When ignition takes place in order to force out the filling (active substance) 15, as already described above, a pressure is built up in the active substance 15 by the piston 21. This pressure forces the sealing ring 155 out of its retaining groove 163 into the position shown in FIG. 21. As indicated by the arrows 170, the active substance 15 can now flow through the free space 171 alongside the stem 165, through the aperture openings 169 and the interior 167, into the nozzle unit 3. The free space 171, the aperture openings 169 and the interior 167 now together form the nozzle entry area which is required to dissipate the pressure peaks in the active substance.

Means for deforming the piston 21 in order to completely dissipate the pressure of the propellant means, for example the pressure relief webs 27, are not illustrated explicitly here but are also, of course, present.

As described above, the propellant charge is preferably in pyrotechnic form. However, propellant charges acting in different ways can also be used, depending on the field of application. For example, it is possible to use just a preloaded spring or a precompressed gas volume.

Figure 24:
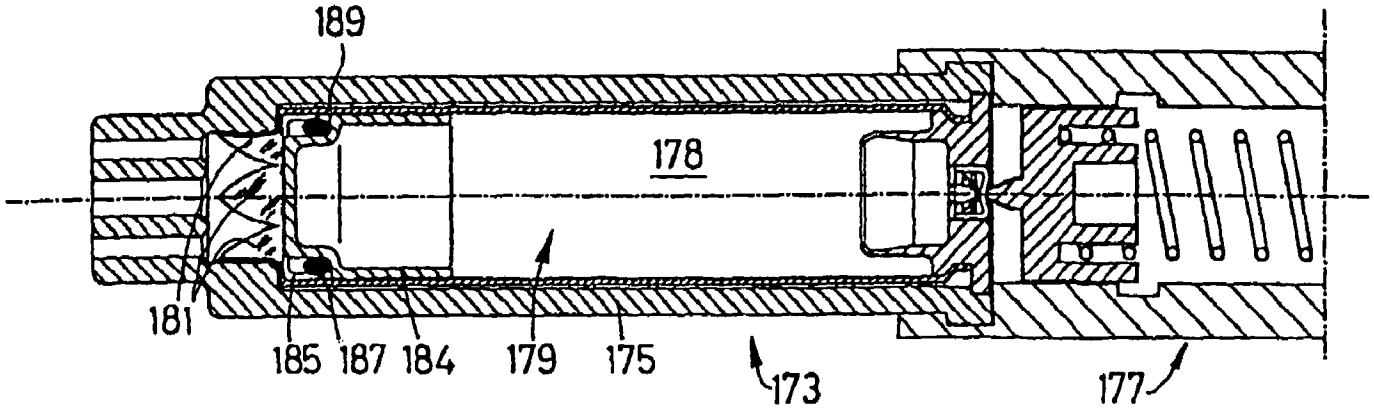
FIG. 24 shows a longitudinal section through the storage unit illustrated in FIG. 23 after the filling has been forced out.

In the above description, the storage units form a unit. However, as is illustrated in FIGS. 23 to 26, it is also possible to use reloadable storage units 173. The storage unit 173 is now constructed in three parts. It has a base unit 175 with the nozzle unit which has already been described above and likewise has a nozzle entry area, and which is identified by 176 here. The nozzle unit 176 is, for example, designed analogously to the nozzle unit 3. Furthermore, the storage unit 173 has an ignition unit which is preferably in the form of a strike ignition unit 177 and has a filling tank 179 having a storage space 178 for an active substance 180 which, in this case as well, may be solid, liquid or gaseous. The strike ignition unit 177 can be connected detachably, but in a robust manner, to the base unit 175. The connection may be a screw connection, a bayonet fitting, a plug connection,. . . . However, the base unit 175 and the strike ignition unit 177 are preferably integrated in a fixed manner in the defensive apparatus or self-defense apparatus. In addition to the solid, liquid or gaseous filling 180, the filling tank 179 has a closure element 181 which can be torn open, a propellant charge 183 and a piston 184 which can be driven against the closure element 181 by the propellant gas from the ignited propellant charge 183. The closure element 181 is part of the sleeve 189 mentioned below, and is designed analogously to the bursting disk 19. Pressure relief webs 185 are formed in an analogous manner to the pressure relief webs 27 in the storage space end area adjacent to the closure element 181. The piston 184 seals the filling tank 179 by means of a sealing ring 187 from the propellant charge 183.

The geometry of the propellant charge 183, as a pyrotechnic propellant cartridge, is designed such that the sleeve which is filled with the filling (which in this case is liquid) and is sealed by the piston 184, preferably a metal sleeve 189 of the filling tank 179, is pushed against it and can then be compressed in a force-fitting manner by means of rolling-in, clinching-in or in some similar way. After this connecting process, the filling tank 179 is a sealed unit, ready for use and intrinsically closed, which can be stored or carried without any problems even over a lengthy time period.

The metal sleeve 189 of the filling tank 179 preferably has thin walls. It may be deep-drawn or extrusion-molded. For economy and weight reasons, the wall thickness is preferably chosen to be sufficiently thin that it could not on its own withstand the pressures which occur when the filling is forced out. Adequate robustness is provided only with the assistance of the robustness of the wall 190 of the base unit 175. The external diameter of the filling tank 179 is now chosen so as to ensure that pushing into a "cartridge chamber" 191 in the base unit 175 is just possible, with a small clearance tolerance. The filling tank 179 is held at the rear in the "cartridge chamber" 191 using a coupling; it could, of course, also be held at the front (at the side on the sleeve edge adjacent to the closure element 181). The coupling for holding purposes has as the first coupling part a step 193 which is arranged at the end of the base part 175 and which, together with the firing cap unit 177, forms a groove in which an attachment 192 on the filling tank 179 is located as the second coupling part.

The base unit 175 and, in general, the firing cap unit 177 as well will be integrated in the self-defense apparatus. The housing can then be opened in order to insert a filling tank or filling tanks. Since the housing of the apparatus is constructed symmetrically in two parts, it can be opened, for example, on the groove 55.

The invention claimed is:

1. A replaceable filling tank for a defensive apparatus, said filling tank having a sleeve, which holds a liquid active defensive substance usable against a personal aggressor, said sleeve having a storage space filled with the active defensive substance and, a fireable propellant charge to force out the filling, said storage space having a storage space end area;

a closure element at the storage space end area, and a piston;

the storage space being closed in a sealed manner toward the propellant charge by said piston;

said filling tank having a rest and a limit position for said piston, the limit position being in the storage space end area;

said piston being driveable towards the closure element from said rest position to said limit position by a propellant gas from the fired propellant charge to force out the active defensive substance by firing the propellant charge, said closure element being designed to be opened by a build up of pressure during firing of the propellant charge in an analogous manner to a bursting disk and being designed to be held or positioned firmly after being opened.

2. The filling tank as claimed in claim 1, wherein said closure element has at least one edge and is designed to be torn open by the build up of pressure during firing in an analogous manner to a bursting disk and being designed to be held firmly at said edge after being torn open.

3. The filling tank as claimed in claim 2, wherein said sleeve has a cylindrical part attached to said closure elements on said edge, said closure element containing weak points at a distance from said edge designed to be torn by the build up of pressure during firing and thereby to produce torn open parts remaining attached to said edge of the closure element when said closure element opens by firing said propellant charge.

4. The filling tank as claimed in claim 3, wherein said weak points are arranged in a star shape.

5. The filling tank as claimed in claim 1, wherein said closure element comprises a sealing element, said sealing element being designed to be forced by the build up of pressure into an open position which allows the substance to flow out of the filling tank.

6. The filling tank as claimed in claim 1, having a free space between the propellant charge and an area of the piston on which a force of the propellan gas produced by the fired propellant acts for ensuring that the piston is accelerated in a uniform manner.

7. The filling tank as claimed in claim 1, having a rest and a limit position for said piston, said piston being moveable from said rest position to said limit position by the propellant gas to force out the active substance, by firing the propellant charge said filling tank having a pressure relief means which interacts with said piston after forcing out essentially all the active substance into a free environment.

8. The filling tank as claimed in claim 7, wherein said pressure relief means allows propellant gas to move past a piston wall of said piston and out through the opened closure element.

9. The filling tank as claimed in claim 7, wherein said pressure relief means comprises at least one projecting web for deforming said piston.

10. The filling tank as claimed in claim 7, having a storage space end area, said pressure relief means being designed as a bypass in the storage space end area adjacent to the closure element, such that, when the piston is in the piston limit position, propellant gas emerges in order to dissipate the propellant gas pressure completely.

11. The filling tank as claimed in claim 1, having a sealing ring sealing the piston against the sleeve.

12. The filling tank as claimed in claim 1, wherein said sleeve is a metal sleeve and said propellant charge is connected in a force fitting manner to said sleeve.

* * * * *